US009231332B2

(12) United States Patent
Chai

(10) Patent No.: US 9,231,332 B2
(45) Date of Patent: Jan. 5, 2016

(54) BUILT-UP PLUG

(71) Applicants: AMBIT MICROSYSTEMS (SHANGHAI) LTD., Shanghai (CN); HON HAI PRECISION INDUSTRY CO., LTD., New Taipei (TW)

(72) Inventor: Hua Chai, Shanghai (CN)

(73) Assignees: AMBIT MICROSYSTEMS (SHANGHAI) LTD., Shanghai (CN); HON HAI PRECISION INDUSTRY CO., LTD., New Taipei (TW)

( * ) Notice: Subject to any disclaimer, the term of this patent is extended or adjusted under 35 U.S.C. 154(b) by 43 days.

(21) Appl. No.: 14/185,040

(22) Filed: Feb. 20, 2014

(65) Prior Publication Data

US 2015/0194759 A1 Jul. 9, 2015

(30) Foreign Application Priority Data

Jan. 8, 2014 (CN) ..... 2014 1 0007807

(51) Int. Cl.

| | |
|---|---|
| ***H01R 13/502*** | (2006.01) |
| ***H01R 13/514*** | (2006.01) |
| *H01R 103/00* | (2006.01) |
| *H01R 105/00* | (2006.01) |
| *H01R 24/28* | (2011.01) |

(52) U.S. Cl.

CPC ..... *H01R 13/514* (2013.01); *H01R 24/28* (2013.01); *H01R 2103/00* (2013.01); *H01R 2105/00* (2013.01)

(58) Field of Classification Search

CPC .. H01R 2103/00; H01R 24/28; H01R 13/512; H01R 27/00; H01R 31/06; H01R 13/514; H01R 13/64; H01R 13/508; H01H 71/08; H01H 71/123

USPC ..... 439/696, 695, 518, 701, 170, 717

See application file for complete search history.

(56) References Cited

U.S. PATENT DOCUMENTS

| | | | | | |
|---|---|---|---|---|---|
| 1,152,170 | A | * | 8/1915 | Goodridge | 200/51 R |
| 1,595,348 | A | * | 8/1926 | McArdle | 439/731 |
| 1,633,827 | A | * | 6/1927 | Siegel | 439/564 |
| 2,326,327 | A | * | 8/1943 | Brewer | 439/291 |
| 2,557,818 | A | * | 6/1951 | Eddy | 439/518 |
| 2,750,572 | A | * | 6/1956 | Fox | 439/472 |
| 2,970,288 | A | * | 1/1961 | Hubbell et al. | 439/657 |
| 3,344,392 | A | * | 9/1967 | Briscoe | 439/599 |
| 3,781,765 | A | * | 12/1973 | Schleicher | 439/472 |
| 4,005,923 | A | * | 2/1977 | Davis, Jr. | 439/651 |
| 4,284,318 | A | * | 8/1981 | Wiley et al. | 439/472 |
| 4,483,575 | A | * | 11/1984 | Kruger et al. | 439/102 |

(Continued)

FOREIGN PATENT DOCUMENTS

| | | |
|---|---|---|
| CN | 2112214 U | 8/1992 |
| CN | 1953280 A | 4/2007 |

*Primary Examiner* — Abdullah Riyami
*Assistant Examiner* — Vladimir Imas
(74) *Attorney, Agent, or Firm* — Novak Druce Connolly Bove + Quigg LLP

(57) ABSTRACT

A built-up plug includes a first portion and a second portion. The first portion includes a first shell, a first metal foot and at least one fixing mass on the first shell. The second portion includes a second shell, a second metal foot and at least one fixing groove on the second shell. The first metal foot protrudes from a top portion of the first shell. The second metal foot protrudes from a top portion of the second shell. The fixing mass is placed in the fixing groove to combine the first portion and the second portion.

8 Claims, 8 Drawing Sheets

(56) References Cited

U.S. PATENT DOCUMENTS

| | | | | |
|---|---|---|---|---|
| 4,682,838 | A * | 7/1987 | Achtnig et al. | 439/598 |
| 6,250,939 | B1 * | 6/2001 | Chou | 439/172 |
| 6,328,596 | B1 * | 12/2001 | Chess et al. | 439/502 |
| 6,712,649 | B2 * | 3/2004 | Mano et al. | 439/835 |
| 6,780,034 | B2 * | 8/2004 | Shiroshita et al. | 439/174 |
| 6,923,666 | B1 * | 8/2005 | Liao | 439/172 |
| 6,991,482 | B1 * | 1/2006 | Liao | 439/166 |
| 7,217,147 | B2 * | 5/2007 | Yoshida et al. | 439/181 |
| 7,220,139 | B1 * | 5/2007 | Chang et al. | 439/172 |
| 7,410,377 | B2 * | 8/2008 | Wharton | 439/172 |
| 7,547,219 | B2 * | 6/2009 | Zhuge | 439/173 |
| 7,658,653 | B2 * | 2/2010 | Diekmann et al. | 439/715 |
| 7,946,244 | B2 * | 5/2011 | Dowler et al. | 116/310 |
| 8,025,514 | B1 * | 9/2011 | Wang | 439/172 |
| 8,894,448 | B2 * | 11/2014 | Affeltranger | 439/701 |
| 8,936,478 | B2 * | 1/2015 | Choi et al. | 439/172 |
| 8,961,243 | B2 * | 2/2015 | Asakuma et al. | 439/695 |

* cited by examiner

BUILT-UP PLUG

BACKGROUND

1. Technical Field

The present disclosure relates to plugs, and more particularly to a built-up plug.

2. Description of Related Art

Two-phase plug or three-phase plug is used in electronic device, and is engaged with two-phase jack or three-phase jack. The two-phase jack is needed when two-phase plug is used. The three-phase jack is needed when three-phase plug is used. However, if only has a three-phase jack when two-phase plug is mounted in electronic device or just have a two-phase jack when a three-phase plug is mounted in electronic device, the plug will not engage with the jack.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

A built-up plug in the present disclosure includes a plurality of portions which can be assembled as a three-phase plug or a two-phase.

Figure 7:
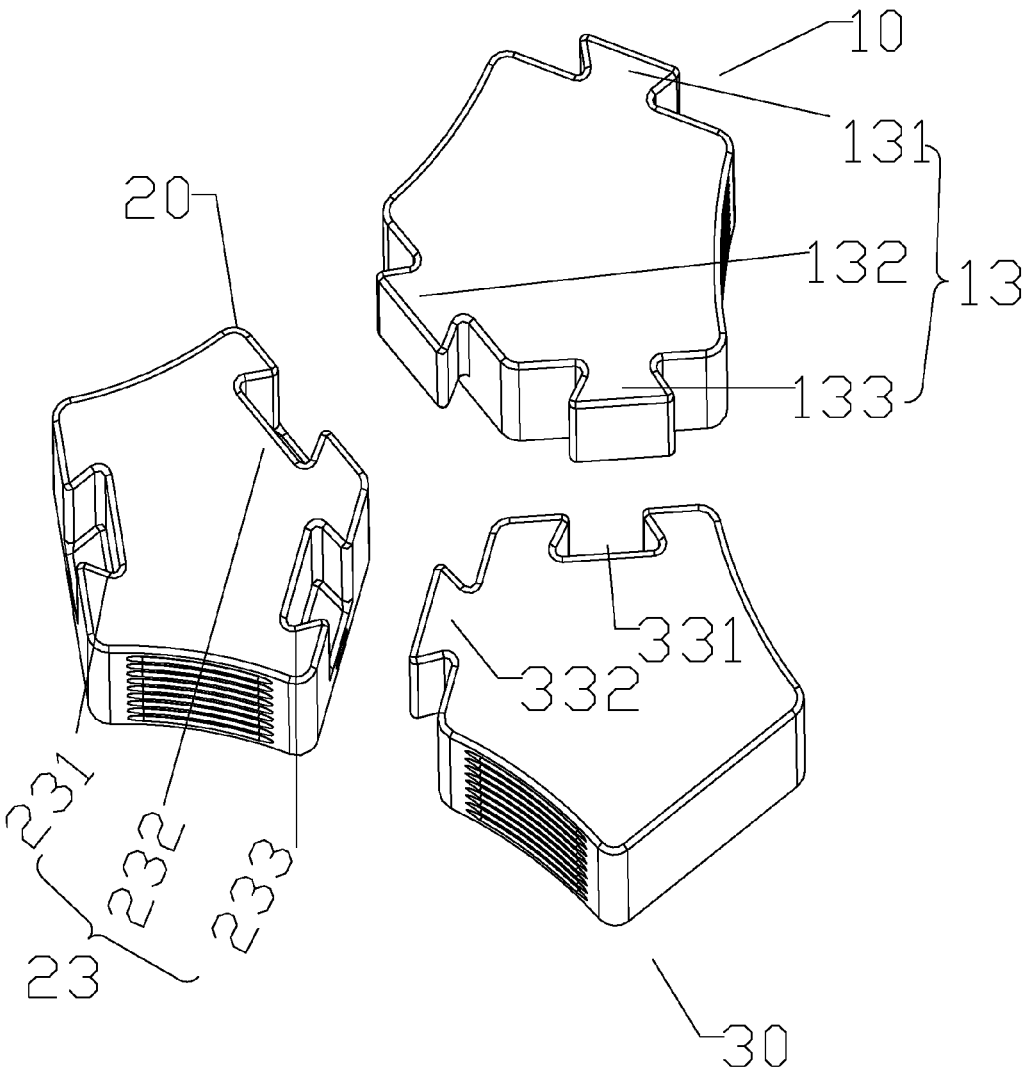
FIG. 7 is an isometric and exploded view of the first portion, the second portion and the third portion in FIGS. 1, 3 and 5 to form a three-phase plug.

Referring to FIG. 7, the plurality of portions at least includes two of a first portion 10, a second portion 20 and a third portion 30.

Figure 1:
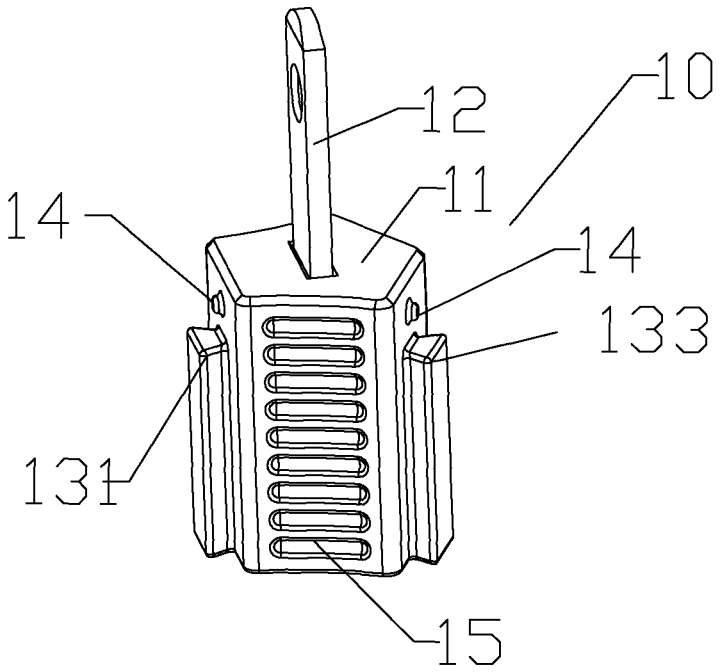
FIG. 1 is a perspective view of a first portion of a built-up plug in accordance with an embodiment of the presently described disclosure.
Figure 2:
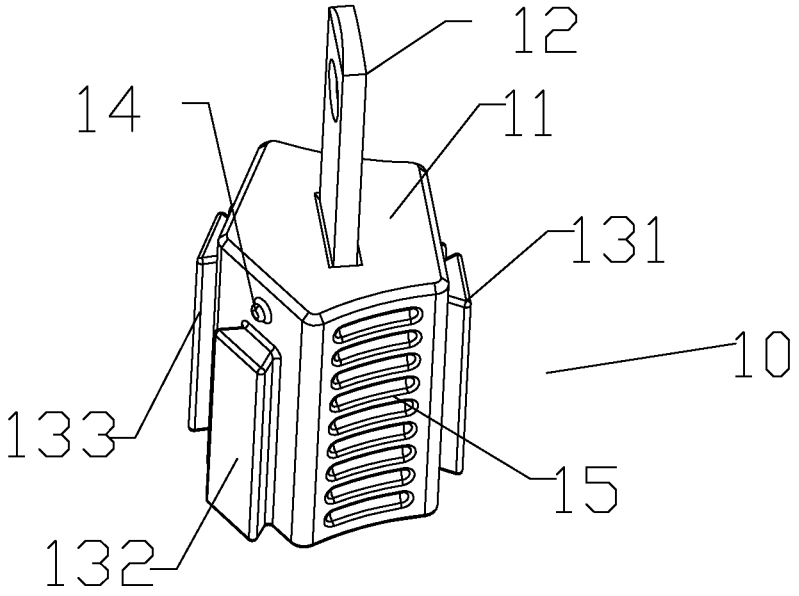
FIG. 2 is another perspective view of the first portion of the built-up plug in FIG. 1.

Referring to FIGS. 1, 2 and 7, the first portion 10 includes a first shell 11 and a first metal foot 12. The first shell 11 is a polygonal column. The first metal foot 12 protrudes from a top portion of the first shell 11. Side of the first shell 11 defines a fixing mass 13. Cross section of the fixing mass 13 is a trapezium. The fixing mass 13 is shorter than the first shell 11. The fixing mass 13 includes a first fixing mass 131, a second fixing mass 132 and a third fixing mass 133. The second fixing mass 132 and the third fixing mass 133 are located on two adjacent sides of the first shell 11, respectively. The first fixing mass 131 is located on another side of the first shell 11 which is not adjacent to the two adjacent sides on which the second fixing mass 132 and the third fixation 133 are located. The first shell 11 forms a protrusion 14 above each of the first fixing mass 131, the second fixing mass 132 and the third fixing mass 133. In present embodiment, the protrusion 14 may be an elastic plastic or a similar elastic material. For gaining manual friction to the built-up plug, the sides of the first shell 11 define two friction portions 15. The friction portions 15 are located on two sides of the first shell 11. In present embodiment, the friction portions 15 are mainly rectangular or curvilinear. The friction portions 15 are arranged from bottom of the first shell 11 to top of the first shell 11.

Figure 3:
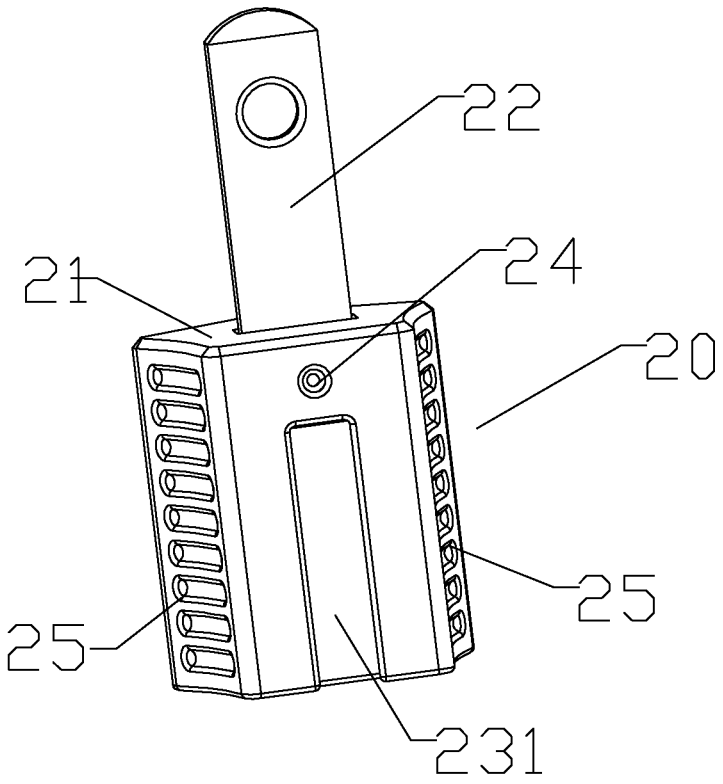
FIG. 3 is a perspective view of a second portion of the built-up plug in accordance with an embodiment of the presently described disclosure.
Figure 4:
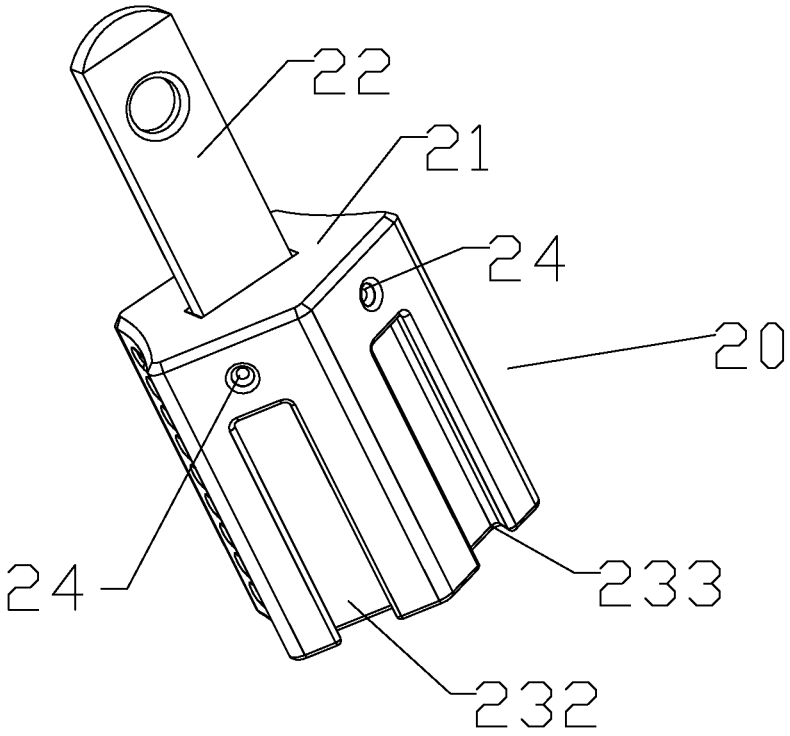
FIG. 4 is another perspective view of the second portion of the built-up plug in FIG. 1.

Referring to FIGS. 3, 4 and 7, the second portion 20 includes a second shell 21 and a second metal foot 22. The second shell 21 is a polygonal column. The second metal foot 22 protrudes from a top portion of the second shell 21. Side of the second shell 21 defines a fixing groove 23. Cross section of the fixing groove 23 is a trapezium. The fixing groove 23 is shorter than the second shell 21. The fixing groove 23 includes a first fixing groove 231, a second fixing groove 232 and a third fixing groove 233. The second fixing groove 232 and the third fixing groove 233 are located on two adjacent sides of the second shell 21, respectively. The first fixing groove 231 is located on another side of the first shell 11 not adjacent to the two sides on which second fixing groove 232 and the third fixing groove 233 are located. The first shell 11 forms a recess 24 above each of the first fixing groove 231, the second fixing groove 232 and the third fixing groove 233. For gaining manual friction to the built-up plug, the sides of the second shell 21 define two friction portions 25. The friction portions 25 are located on two sides of the second shell 21. In the embodiment, the friction portions 25 are mainly rectangle or curvilinear. The friction portions 25 are arranged from bottom of the second shell 21 to top of the second shell 21.

Figure 5:
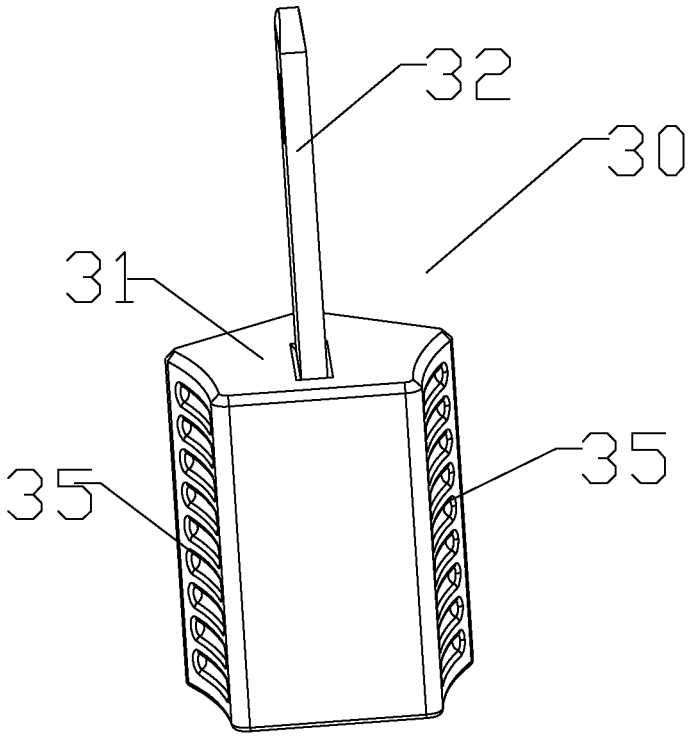
FIG. 5 is a perspective view of a third portion of the built-up plug in accordance with an embodiment of the presently described disclosure.
Figure 6:
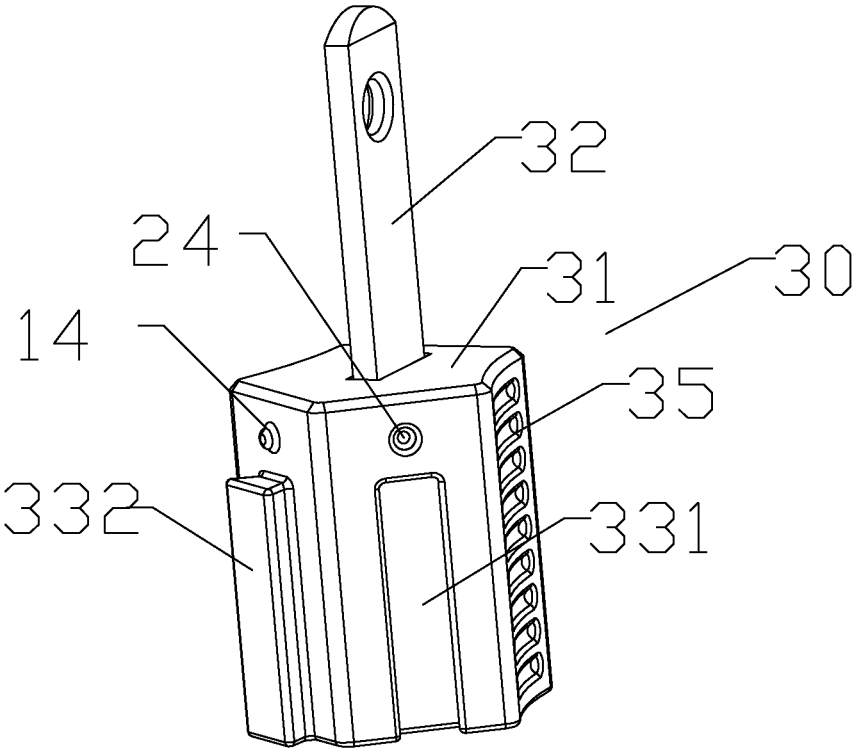
FIG. 6 is another perspective view of the third portion of the built-up plug in FIG. 1.

Referring to FIGS. 5 and 6, the third portion 30 includes a third shell 31 and a third metal foot 32. The third shell 31 is a polygonal column. The third metal foot 32 protrudes from a top portion of the third shell 31. The sides of the third shell 31 define a forth fixing groove 331 and a forth fixing mass 332. Cross section of the forth fixing groove 331 and the forth fixing mass 332 is a trapezium, respectively. The forth fixing groove 331 and the forth fixing mass 332 are located two adjacent sides of the third shell 31, and are shorter than the third shell 31. The third shell 31 forms a protrusion 14 above the forth fixing mass 332. The third shell 31 forms a recess 24 above the forth fixing groove 331. The protrusion 14 may be an elastic plastic or a similar elastic material. For gaining manual friction to the built-up plug, the sides of the third shell 31 define two friction portions 35. The two friction portions 35 are located on two sides of the third shell 31. In present embodiment, the friction portions 35 are mainly rectangle or curvilinear. The friction portions 35 are arranged from bottom of the third shell 31 to top of the third shell 31.

To assemble a three-phase plug, the second fixing mass 132 of the first portion 10 is manually slid into the second fixing groove 232 from the open end of the second fixing groove 232 of the second portion 20, and simultaneously the protrusion 14 located above the second fixing mass 132 is driven into the recess 24 located above of the second fixing groove 232 in hustling. Thus, the first portion 10 and the second portion 20 are combined. Then, the forth fixing mass 332 of the third portion 30 is manually slid into the third fixing groove 233 from the open end of the third fixing groove 233 of the second portion 20, and simultaneously the third fixing mass 133 of the first portion 10 is slid into the forth groove 331 from the open end of the forth groove 331 of the third portion 30. Thus, the first portion 10, the second portion 20 and the third portion 30 are combined to form the three-phase plug, and it is held securely because the protrusion 14 is engaged with the recess 24, as shown in FIG. 7.

Figure 8:
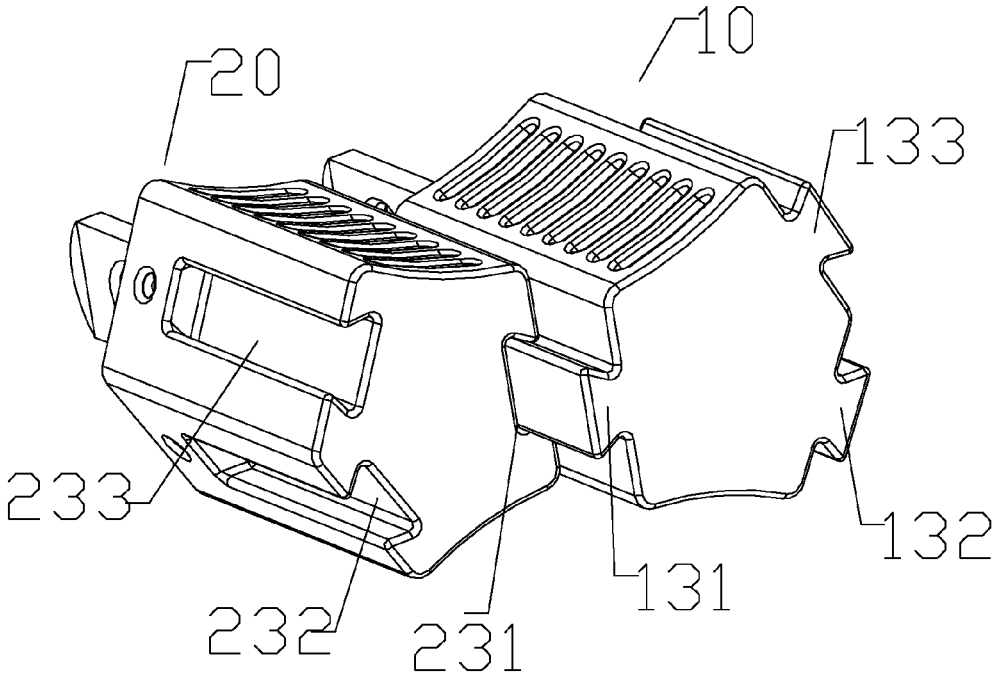
FIG. 8 is an isometric and assembled view of the first portion and the second portion in FIGS. 1 and 3 to form a two-phase plug.

To assemble a two-phase plug, the first fixing mass 131 of the first portion 10 is manually slid into the first fixing groove 231 from the open end of the first fixing groove 231 of the second portion 20, and simultaneously the protrusion 14 located above of the first fixing mass 131 is driven into corresponding recess 24 in hustling. Thus, the first portion 10 and the second portion 20 are combined to form the two-phase plug, and it is held securely because the protrusion 14 is engaged with the recess 24, as show in FIG. 8.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A built-up plug, comprising:

a first portion comprising a first shell, a first metal foot protruded from a top portion of the first shell, and at least one fixing mass on the first shell; and a second portion comprising a second shell, a second metal foot protruded from a top portion of the second shell, and at least one fixing groove on the second shell; wherein the fixing mass of the first portion is placed into the fixing groove of the second portion to combine the first portion and the second portion; wherein the first shell forms a protrusion above the fixing mass, the second shell forms a recess above the fixing groove, the protrusion can be elastically deformed, and the protrusion is driven into the recess in hustling.

2. The built-up plug of claim 1, wherein both the first shell and the second shell are polygonal columns.

3. The built-up plug of claim 2, wherein the fixing mass is located on one side of the first shell and the fixing groove is located on one side of the second shell.

4. The built-up plug of claim 3, wherein cross sections of the fixing mass and the fixing groove are trapeziums.

5. The built-up plug of claim 2, wherein sides of the first shell and the second shell define two friction portions for gaining manual friction to the built-up plug, respectively.

6. The built-up plug of claim 1, further comprising a third portion, wherein the third portion comprises a third shell, a third shell metal, a forth fixing mass and a forth fixing groove, the third metal foot protrudes from a top portion of the third shell, the at least one fixing groove of the second portion comprises a first fixing groove, a second fixing groove and a third fixing groove, the at least one fixing mass of the first portion comprises a first fixing mass, a second fixing mass and a third fixing mass, the second fixing mass is placed in the second fixing groove, the third fixing mass is placed in the third fixing groove and the forth fixing mass is placed in the third fixing groove to combine the first portion, the second potion and the third portion.

7. The built-up plug of claim 6, wherein cross section of the forth fixing mass and the forth fixing groove are trapeziums.

8. The built-up plug of claim 7, wherein the third shell forms a protrusion above the forth fixing mass, the third shell forms a recess above the forth fixing groove, and the protrusion is elastically deformed to be driven into the relevant recess in hustling.

* * * * *